United States Patent [19]

Girard

[11] Patent Number: 5,076,186

[45] Date of Patent: Dec. 31, 1991

[54] SAILBOAT PROVIDED WITH AN ANTI-HEELING AND SUPPORT DEVICE

[76] Inventor: Marc Girard, 4 Boulevard de la Victoire, Strasbourg, France

[21] Appl. No.: 427,117

[22] PCT Filed: Feb. 22, 1989

[86] PCT No.: PCT/FR89/00069

§ 371 Date: Oct. 20, 1989

§ 102(e) Date: Oct. 20, 1989

[87] PCT Pub. No.: WO89/08046

PCT Pub. Date: Sep. 8, 1989

[30] Foreign Application Priority Data

Feb. 23, 1988 [FR] France ..... 88 02338

[51] Int. Cl.[5] ..... B63H 9/06

[52] U.S. Cl. ..... 114/102; 114/39.1; 114/103

[58] Field of Search ..... 114/39.1, 102, 103, 114/280

[56] References Cited

U.S. PATENT DOCUMENTS

| | | | |
|---|---|---|---|
| 2,858,788 | 11/1958 | Lyman | 114/280 |
| 3,593,684 | 7/1971 | Cogliano | 114/61 |
| 3,720,180 | 3/1973 | Stangeland | 114/102 |
| 3,884,172 | 5/1975 | Takahashi | 114/39.1 |
| 4,027,614 | 6/1977 | Jones | 114/280 |
| 4,563,970 | 1/1986 | Walker | 114/103 |
| 4,610,212 | 9/1986 | Petrovich | 114/39.1 |
| 4,674,427 | 6/1987 | Finot | 114/103 |
| 4,788,924 | 12/1988 | Hamel | 114/39.1 |
| 4,852,507 | 8/1989 | Ryan et al. | 114/102 |

FOREIGN PATENT DOCUMENTS

| | | | |
|---|---|---|---|
| 1127911 | 7/1982 | Canada | 114/102 |
| 3231764 | 3/1984 | Fed. Rep. of Germany | 114/102 |
| 2498554 | 7/1982 | France | 114/102 |
| 2532614 | 3/1984 | France | 114/103 |
| 2563489 | 10/1985 | France | 114/103 |
| 8304441 | 7/1985 | Netherlands | 114/102 |

*Primary Examiner*—Sherman Basinger
*Assistant Examiner*—Thomas J. Braham
*Attorney, Agent, or Firm*—Young & Thompson

[57] ABSTRACT

A sailboat having a vertical mast supporting vertical sails thereon that extend vertically lengthwise of the mast, and a keel and a rudder. At the upper end of the mast a wing is connected, the wing comprising an arm fixed at one end to the framework of the wing and interconnected for universal movement about three orthogonal axes to the upper end of the mast, these three orthogonal axes passing through the upper end of the mast. The position of the wing can be controlled relative to the mast. The wing has on its underside a fin terminating rearwardly in a rudder adjustable relative to the fin, and on its trailing edge two flaps of adjustable inclination.

6 Claims, 2 Drawing Sheets

SAILBOAT PROVIDED WITH AN ANTI-HEELING AND SUPPORT DEVICE

The present invention concerns the field of construction of sailing boats, and has as an object a sailboat provided with an anti-heeling and support device.

At present, with conventional sailboats of the single hull or multi-hull type, the aerodynamic thrust of the wind on the sails is substantially normal to these latter and generally strongly oblique with respect to the axis of the boat, such that there is created a very substantial leeward heeling torque, which must be offset by a restoring torque generated by the weight forces, including the weight of the boat, the weight of the keel, which is often very heavy, and the weight of the passengers, who are sometimes positioned for purposes of adjustment. Under the action of these different weights and the vertical component of the aerodynamic thrust on the sails, the hull or hulls have a tendency to become submerged in the water, such that in any event a significant volume of the boat is submerged, resulting in a hydrodynamic drag exerting the principal braking action on the advancement of the boat.

Moreover, any increase of the aerodynamic thrust results in a corresponding increase in the speed and requires to increase in a corresponding manner the weight of antiheeling ballast. An increase of the hydrodynamic drag thus occurs for two reasons, namely, because of the increase of speed, and because of the increase of the submerged volume, whereby the actual gain in speed of movement is relatively slight in comparison to the increase in aerodynamic thrust.

To overcome these disadvantages, it has been proposed to replace the sails typically fixed to the mast of sailboats with riggings in the form of wings mounted at the head of the mast and maneuverable from the deck by means of ropes. These riggings have as their object to assure simultaneously the propulsion and to act on the heeling of a boat and thus to limit the weight of the keel, but effect a concentration of the forces acting on the mast at the head of this latter, such that its section must be maintained very strong, especially at the level of its attachment to the deck.

Moreover, these riggings do not permit reducing in any significant way the volume of the submerged volume and the hydrodynamic drag.

The present invention has as an object to overcome all these disadvantages by providing a nearly complete elimination of the submerged keel volume, and thus of the drag, while compensating the heeling torque so as to effect a considerable lightening of the sailboat, which may thus move at a high speed by gliding on the surface or above the surface of the water, according to the force of the wind.

Specifically, it has as an object a single hull or multi-hull sailboat provided with at least one mast for securing one or several sails, a centerboard and a rudder, characterized in that it is provided with an anti-heeling and support device connected at the head of the mast for limited pivotal movement about this latter.

The invention will be better understood thanks to the following description, which refers to preferred embodiments, given by way of non-limiting example, and explained with reference to the accompanying schematic drawings, in which.

Figure 1:
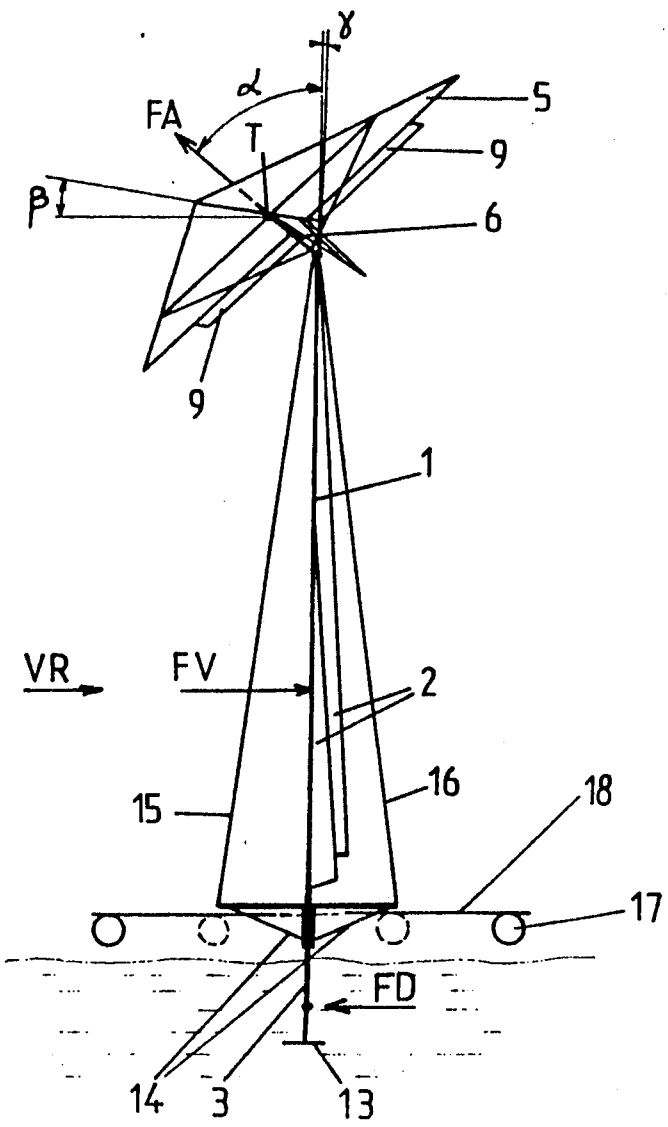
FIG. 1 is a view in front elevation of a sailboat according to the invention.
Figure 2:
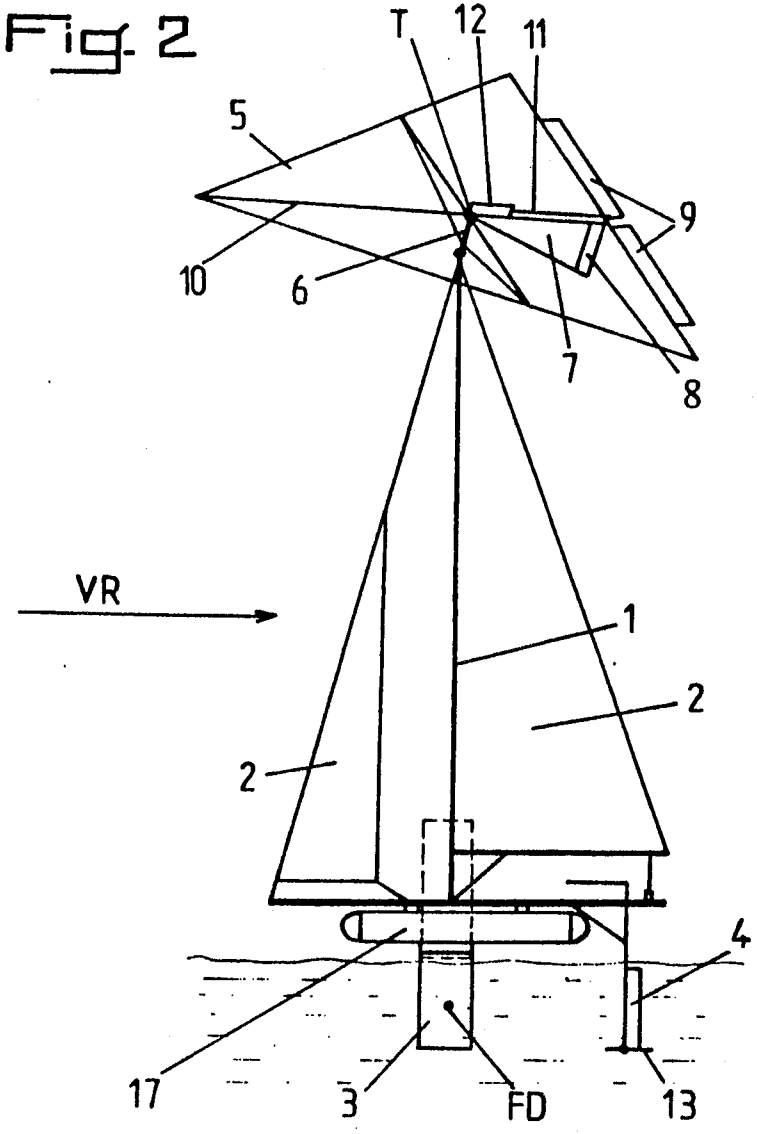
FIG. 2 is a view in side elevation of the sailboat according to FIG. 1.

According to the invention, and as is more particularly shown by way of example in FIGS. 1 and 2 of the accompanying drawings, the sailboat, of the catamaran type, which is provided with a mast 1 for fixation of one or several sails 2, a centerboard or drop-keel 3 and a rudder 4, is provided with an anti-heeling and support device 5 connected at the head of the mast 1 for limited pivotal movement about this latter.

The anti-heeling and support device 5 is advantageously constituted in the form of a wing connected to the head of the mast 1 by means of an arm 6 fixed at one end to the frame-work of the wing and provided at its other end with a pivotal head cooperating with a housing of corresponding shape on the head of the mast 1 in the manner of a ball-and-socket joint, the housing creating a limitation of the said pivotal movement of the arm 6 about three orthogonal axes passing through the head of the mast 1.

According to a characteristic of the invention, the support device or wing 5 is provided with its own fin 7/rudder 8 assembly.

According to another characteristic of the invention, the support device or wing 5 is provided at its rear flight edge with two flaps 9 of adjustable inclination.

The pivotal movement of the arm 6 in the housing of the head of the mast 1 may also be controlled by means of ropes (not shown) connected on the one hand to the ends of the wing 5, and on the other hand to mechanical, electromechanical or the like actuating means, provided on the deck of the sailboat. These actuating means may be constituted by mechanical or electro-mechanical winches, or also by mechanical, hydraulic or pneumatic jacks, either manually actuated or motorized. Thanks to these embodiments, the arm 6 and the wing 5 are articulated to the head of the mast 1 along three orthogonal axes permitting their orientation in all useful directions, namely a complete rotation about the axis of the mast 1 permitting the wing 5 to be positioned with its nose into the wind, in the manner of a weathervane, this alignment being assured by the thrust of the wind on the underside of the wing 5 and on its keel 7/rudder 8 plane, an inclination to the left or to the right which may extend up to 90° with respect to the axis of the mast 1, causing the inclination $\alpha$ of the wing 5, by acting on the corresponding flaps 9, and an inclination with respect to the direction of movement of the sailboat, creating the leading angle $\beta$ of the wing 5 with respect to the horizontal wind component VR, also by acting on the flaps 9.

According to another characteristic of the invention, the arm 6 is fixed to the wing 5 on the longitudinal axis 10 of this latter at a point T which is adjustable on the said axis 10, this point T being situated forwardly of the centers of gravity and aerodynamic effect of the wing 5. Thus, it is assured that the wing 5 will always present its nose to the wind, with its underside directed toward the mast 1.

The control of the movements of the rudder 8 and flaps 9 is advantageously realized by means of battens 11 which are actuated by linear motors such as electric or pneumatic jacks 12 controlled from the deck by means of a housing having an operating member of the "broomstick" type acting on a rheostat or on a pneumatic distributor, and whose energy is furnished by a battery mounted on the deck or by a source of compressed air, the control of this latter or charging of the battery being effected by means of a hydraulic propeller or by means of a turbine driven through an opening provided on the leading edge of the centerboard 3, operating a dynamo or an alternator or a compressor.

In view of the speeds which can be attained by means of the sailboat according to the invention, the use of a dynamo or an alternator or also a compressor, operated by a hydraulic propeller or by a turbine is rendered possible and permits the use of a free source of energy capable of providing for all the energy needs.

The inclination of the wing 5, on t he one hand, an angle $\alpha$ of the side to the wind and, on the other hand, a leading angle $\beta$ with respect to the horizontal wind component VR induces a resultant aerodynamic thrust FA on the wing 5 which is near the axis of the arm 6. This latter has two very important effects on the boat, namely, on the one hand, a sustaining force, and, on the other hand, an effect of an anti-heeling restoring torque.

The sustaining force is obtained by the action of the vertical component of the aerodynamic thrust FA which compensates the downwardly directed vertical forces, namely the weight of the sailboat, and the vertical component of the thrust on the sails FV, such that the sailboat has a tendency to be lifted from the water in the direction of the mast 1 at the level of the connection of the head of the said mast 1 with the arm 6 fixed to the wing 5. Thus, adjustment of the leading angle $\beta$ causes a change of altitude of the sailboat which results in the lifting on its body from the water.

The anti-heeling restoring torque is obtained by the action of the aerodynamic thrust FA on the wing 5, in the form of a force acting on the head of the mast 1 creating a ballasting torque which offsets the heeling torque about a point D of the centerboard 3, due to the action of the wind on the sail or sails 2, such that the inclination $\gamma$ of the mast is stabilized. A significant anti-heeling torque may be obtained with a relatively weak aerodynamic thrust FA, by use of a mast of significant length, the mast forming the lever arm.

Thus, the assembly according to the invention is stable and the hydrodynamic drag, which is the principal braking action acting against displacement, is very much reduced. Specifically, under normal conditions the only submerged volume of the sailboat is that of the centerboard 3 and rudder 4, which is thus reduced to a very slight surface, almost planar and very thin, and advances on edge in the manner of a cutting blade. Consequently, the sailboat thus constituted advances by gliding above the water at a speed much greater than that of corresponding sailboats of the conventional type, and this speed is several times greater than that of the existing wind.

According to another characteristic of the invention, the rudder 4 is provided, near its lower end, with a stabilizing vane 13 fixedly mounted on the said rudder 4. Such a vane permits assuring horizontal stability of the axis of the sailboat in its plane of symmetry. This vane is advantageously mounted substantially parallel to the deck. It is also possible to make the stabilizing vane 13 adjustable in inclination with respect to the deck of the sailboat, by mounting by means of a pivotal axis on the rudder 4 and manual actuation or by means of a batten which may be locked in position or hydraulically, mechanically or electrically controlled actuation by means of a central control assembly.

When the rotational torques exerted in the plane of symmetry of the sailboat are offset, this latter is on an even keel relative to the horizontal, and the stabilizing vane 13 has no effect other than a slight drag. Upon disruption of the equilibrium of these torques, the sailboat assumes a positive or negative trim, whereupon the stabilizing vane 13 becomes supporting, such that its hydrodynamic bearing creates a restoring torque tending to reduce the trim. This restoring torque is significant, as the lever arm with respect to the center of gravity of the sailboat is substantial, as is the lift at high speed when the trim appears.

Practically, the sailboat will be constructed such that the aero- and hydrodynamic torques under consideration will be near the equilibrium, without operation of the stabilizing vane 13. Moreover, the optional possibility of adjusting the trim of the vane 13 with respect to the plane of the deck permits optimizing the equilibrium between the torques at any moment, and thus optimizing the performance of the sailboat, thus assuring to its axis a stability near the horizontal.

Adjustment of the altitude of the sailboat with respect to the plane of water is effected by modification of the inclinations $\alpha$ and $\beta$ of the wing 5, by acting on the flaps 9 of adjustable inclination. This adjustment of the inclinations $\alpha$ and $\beta$ also permits acting on the inclination 7 of the mast 1. It is thus possible, in particular, to maintain the mast 1 at the vertical, that is to say with an angle $\gamma = 0$ or, in the case of slight wind, to effect an inclination of the mast 1 toward the wind, that is to say with a negative angle $\gamma$, the sail or sails 2 both contributing to the support.

The taking off of the ship body from the water occurs at wind speeds greater than a minimal speed, which depends, on the one hand, on the surface of the wing 5 and, on the other hand, on the surface of the propulsion sails 2 and the total weight of the sailboat. Thus, the minimum speed of the wind permitting the lifting of the ship body out of the water will be established between 7 and 15 knots, a condition often encountered in practice. In the case of wind speed less than this minimum, a complete taking off is not possible but, nevertheless, the wing 5 continues to perform its role of lightening the sailboat and contributing to the offset of listing, such that, with respect to a conventional sailboat of the same type and subject to identical wind force, the possible windward stress on the floatation member and, in any case, the heeling are considerably reduced.

Navigation on the surface of the water with a sailboat according to the invention is thus effected with much lighter winds than for conventional sailboats, and this mode of very rapid navigation precedes the complete taking off which occurs when the wind speed exceeds the requisite minimum speed.

The centerboard or drop-keel 3 is advantageously in the form of a plate of slight thickness, having a frontal section decreasing in the direction of the foot and having an elastic height limit, rigidly fixed beneath the deck, with the possibility of vertical sliding, and stayed with respect to the deck by means of stay rods 14 fixed to the sides of the centerboard. This centerboard 3 permits, as on conventional sailboats, limiting the drift of the boat by acting on the water, but nevertheless, the anti-drift thrust FD which it supports is strongly increased. The material constituting the centerboard 3 could be, for example, aluminum, and its particular front section, decreasing in the direction of the foot, is adapted to the variation of the flexural torque so as to reduce the weight of the centerboard. Moreover, it advantageously has a height greater than its width, so as to maintain a sufficient submerged support surface in rough water or in the case of variations of altitude. Finally, the possibility of vertical sliding of the centerboard 3 in its mounting on the deck of the sailboat permits adjustment of its height as a function of the navigation conditions, as well as its complete retraction to a position of stowage and transport. The same is true of the rudder 4 by vertical sliding along its axis of orientation.

The other elements of the sailboat according to the invention are, in principle, similar to those of a conventional sailboat of the corresponding type. Nevertheless, their technical characteristics are substantially modified. Specifically, the anti-heeling thrust FA creates at the summit of the mast 1 a support against the wind which does not exist on conventional sailboats, such that the leeward shroud 15 is not under tension and, at an equal heeling force FV, the mast 1 is less urged in torsion than on a conventional sailboat and may thus be lighter. This latter benefit may be put to advantage for optimizing the mast, that is to say, for using higher masts so as to increase the propulsion force FV and thus the speed.

The leeward shroud 16 is under moderate tension to prevent the rotation of the ship body or the frame of the sailboat about the foot of the mast under the effect of the anti-leeway thrust FD.

Because the speed attained with the sailboat according to the invention corresponds most often to the wind component VR near the front of the boat, the sails 2 are near the plane of symmetry of the boat and may be constrained. So as to overcome this inconvenience, the jib could be of reduced width so as to remove its trailing edge from the large sail.

According to another characteristic of the invention, and as shown in FIG. 1, in the case of a sailboat having a multi-hulled body, the flotation members 17 of this latter are advantageously mounted on telescopic arms 18 adjustable in extent with respect to the deck or the central body, in a fixed or continuous manner, by means of assembly bolts or by means of linear motors. Thus, the flotation members 17 may be drawn together to a minimum distance from the central body or from the deck, in a position of stowage and transport and may be spread apart to a use position, this spreading apart being, if desired, varied in the course of their use so as to optimize the efficiency of the sailboat.

Figure 3:
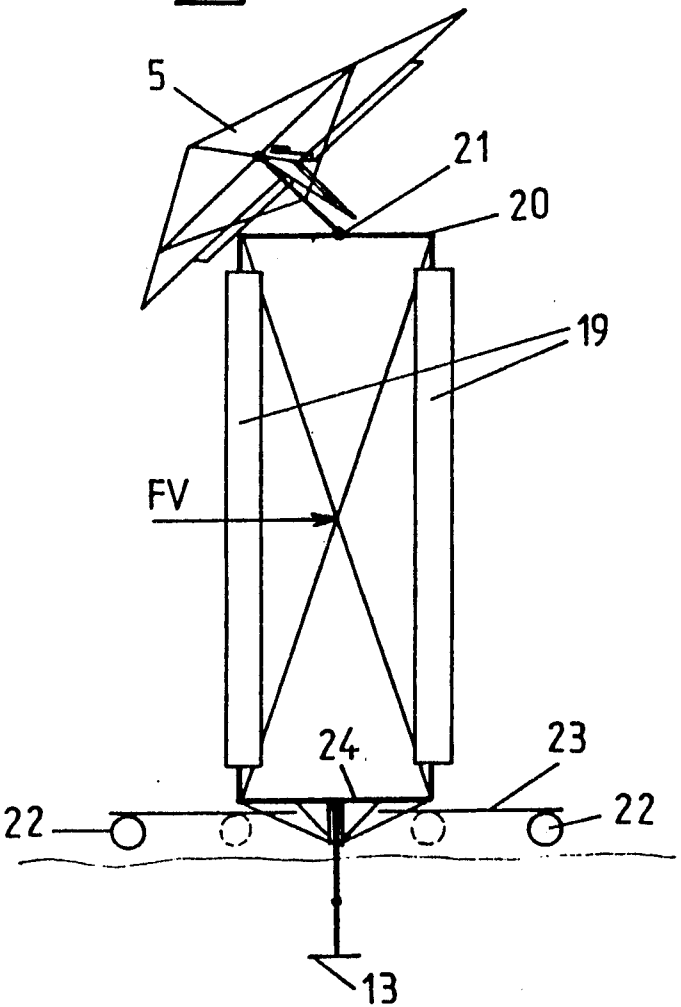
FIG. 3 is a view similar to that of FIG. 1 of a different embodiment of the invention.
Figure 4:
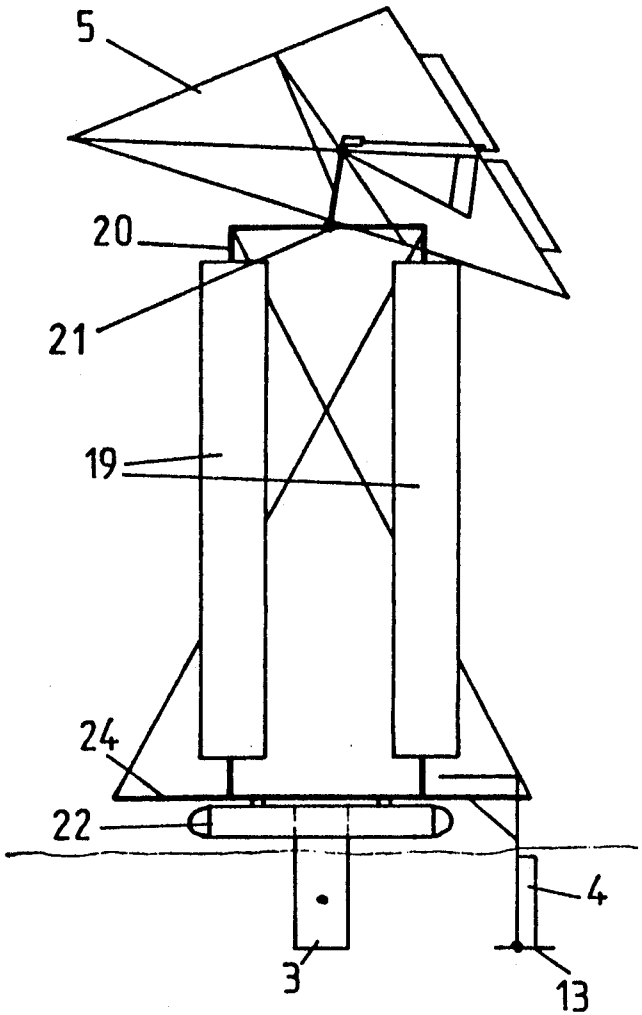
FIG. 4 is a view similar to FIG. 2 of the sailboat according to FIG. 3.

FIGS. 3 and 4 show a different embodiment of the invention in which the sails 2 are replaced by rigid wings 19 movable about integrated masts, these wings 19 being distant from one another so as to receive independent airflows, the support device 5 being connected to a chassis 20 at a point 21 forming the aerodynamic barycenter of the summits of the masts of the wings 19. In the pictured embodiment, the sailboat is in the form of a catamaran whose flotation members 22 act as the ship body only in the stages of taking off from and landing back onto the water, that is, at low speed. Moreover, during these two stages, the stress on the leeward flotation member is reduced thanks to the influence of the wing 5, the flotation members 22 and the bearing arms 23 connecting them to the frame 24 are subjected to much weaker forces than on conventional multi-hulled boats, and may thus be considerably lightened, which also contributes to the reduction of the total weight.

The flotation members 22 may be constituted by very light materials, such as for example simple inflatable cylinders provided with aerodynamic tips, and lightweight bearing arms 23 of reduced section may be slidingly mounted beneath the frame 24 so as to adjust their wing span.

According to another characteristic of the invention, so as to optimize the performance of the sailboat, the masts of the wings 19 are advantageously mounted on transverse arms housed in a telescopic manner in the frame 20 for connection with the wing 5 and in cross-pieces fixed to the frame 24, the said transverse arms being displaceable and adjustable in spacing by means of rack and pinion assemblies or jacks.

Thanks to the invention, it is possible to realize a sailboat capable of attaining great speeds at the level of, and in particular, above the water, by utilization of the principle of propulsion by aerodynamic pressure of the wind on a system of sails or wings carried by one or several vertical masts combined with an orientable aerial wing fixed on the mast-head and simultaneously creating effects of support and anti-heeling torque permitting the boat to be raised in the first instance from the surface of the water, then to accelerate and to take off above the level of the water for subsequent navigation by equilibrated support, with an almost total suppression of the hydrodynamic drag on the boat body.

It will be understood that the invention is not limited to the embodiments described and shown in the accompanying drawings. Modifications remain possible, especially from the point of view of construction of the various elements, or by substitution of equivalent techniques, without departing whatsoever from the scope of protection of the invention.

I claim:

1. A sailboat having vertical mast means supporting vertical sail means thereon that extend vertically lengthwise of the mast means, a keel and a rudder, and at the upper end of the mast means a wing connected to the upper end of the mast means, said wing comprising an arm fixed at one end to framework of the wing and interconnected for universal movement about three orthogonal axes to the upper end of the mast means, said three orthogonal axes passing through the upper end of the mast means, and means to control the position of the wing relative to the mast means, said wing having on its underside a fin terminating rearwardly in a rudder adjustable relative to the fin.

2. A sailboat as claimed in claim 1, wherein the wing has on its trailing edge two flaps of adjustable inclination.

3. A sailboat as claimed in claim 1, wherein said arm is secured to said framework of the wing at a point spaced a substantial distance inwardly from all edges of the wing.

4. A sailboat as claimed in claim 1, the mast means comprising a single mast.

5. A sailboat as claimed in claim 4, said sail means comprising flexible sails.

6. A sailboat having vertical mast means supporting vertical sail means thereon that extend vertically lengthwise of the mast means, a keel and a rudder, and at the upper end of the mast means a wing connected to the upper end of the mast means, said wing comprising an arm fixed at one end to framework of the wing and interconnected for universal movement about three orthogonal axes to the upper end of the mast means, said three orthogonal axes passing through the upper end of the mast means, and means to control the position of the wing relative to the mast means, said mast means comprising plural spaced masts, said sail means comprising rigid sails on said plural masts.

* * * * *